United States Patent [19]

Vandevier

[11] Patent Number: 4,834,174

[45] Date of Patent: May 30, 1989

[54] COMPLETION SYSTEM FOR DOWNHOLE STEAM GENERATOR

[75] Inventor: Joseph E. Vandevier, Claremore, Okla.

[73] Assignee: Hughes Tool Company, Houston, Tex.

[21] Appl. No.: 121,560

[22] Filed: Nov. 17, 1987

[51] Int. Cl.[4] ..... E21B 43/24

[52] U.S. Cl. ..... 166/60; 166/65.1; 166/188; 166/272; 166/303

[58] Field of Search ..... 166/58, 59, 60, 61, 166/65.1, 133, 188, 189, 272, 273, 275, 302, 303

[56] References Cited

U.S. PATENT DOCUMENTS

| | | | |
|---|---|---|---|
| 2,276,833 | 3/1942 | Germain | 219/33 |
| 3,045,099 | 7/1962 | Bowman et al. | 166/60 |
| 3,131,763 | 5/1964 | Kunetka et al. | 166/60 |
| 4,078,613 | 3/1978 | Hamrick et al. | 166/303 |
| 4,185,691 | 1/1980 | Tubin et al. | 166/250 |
| 4,411,618 | 10/1983 | Donaldson et al. | 166/59 |
| 4,694,907 | 9/1987 | Stahl et al. | 166/65.1 |

*Primary Examiner*—Jerome W. Massie
*Assistant Examiner*—Terry Lee Melius
*Attorney, Agent, or Firm*—James E. Bradley

[57] ABSTRACT

A steam generator is located downhole in a well for generating steam to cause viscous crudes to flow out adjacent walls. A packer is mounted above the steam generator. A connector box is located between the packer and the steam generator. An electrical cable extends alongside tubing into the well and into a window in the tubing located just above the packer. The cable extends through a passage in the packer and into the connector box. Feedthrough connectors in the connector box connect the power cable with lead wires extending upward from the steam generator. Heat pipes extend from the connector box upward through the packer. The heat pipes contain gas which circulates to aid in dissipating heat from the connector box.

3 Claims, 4 Drawing Sheets

COMPLETION SYSTEM FOR DOWNHOLE STEAM GENERATOR

CROSS-REFERENCE TO RELATED APPLICATION

This application is being filed simultaneously with an application containing some common subject matter, and which is entitled "PACKER COOLING SYSTEM FOR A DOWNHOLE STEAM GENERATOR ASSEMBLY", Ser. No. 121,485 filed Nov. 17, 1987, by inventors John Lindley Baugh, et al.

BACKGROUND OF THE INVENTION

1. Field of the Invention

This invention relates in general to a system for generating steam downhole in oil wells, and in particular to a packer and electrical connector apparatus used with a steam generator.

2. Description of the Prior Art

Steam is used in some cases to facilitate the production of oil from reservoirs having very viscous crude. In the prior art, steam is generated at the surface and pumped down tubing in injection wells. The steam will flow through perforations in the casing of the injection well to heat the crude and force it to flow to producing wells.

One disadvantage of steam injection systems is the energy loss which occurs as the steam cools while being pumped from the surface down to the perforations. This is particularly a problem in deeper wells.

Proposals have been made to pump water down the well and generate the steam downhole. This would avoid the heat loss that occurs while the steam is being pumped down the well in conventional systems. The downhole steam generator would generate the steam using high voltage electrical power supplied through electrical cable extending down into the well. A packer above the steam generator would prevent the steam from flowing back up the annulus of the well.

One problem presented by a downhole steam generator is providing the electrical connections. Conventional downhole electrical connections are unable to withstand the high temperatures at the voltage and power levels required. The power requirements for a downhole steam generator are high, up to 7200 volts and 240 amps. The temperatures are high, possibly exceeding 600 degrees F.

Packers are available that have feed through mandrels for electrical wires to be connected for purposes other than downhole steam generators. The feed through mandrel is located to one side of the main conduit in the packer for the tubing. The feed through mandrel has insulated conductor rods extending through the packer. The lower end of the upper section of the cable is connected to the upper end of the connector rod. The upper end of the lower section of cable below the packer is connected to the lower end of the conductor rod.

The conventional feed through mandrel would not be acceptable for use in a downhole steam generator system. The high temperatures would cause deterioration of the elastomeric insulators in the feed through mandrel. Also, the feed through mandrel has a rather small diameter, necessitating that the three conductors from the power cable be spaced quite close to each other.

This results in the possibility of insulation failure between the conductors because of the high voltage.

SUMMARY OF THE INVENTION

In this invention, a connector box is located between the downhole steam generator and the packer. The connector box is an insulated sealed housing that extends downward from the packer. The connector box communicates with the interior of the packer and with the suspension tubing that extends upward from the packer.

The power cable extends down from the surface alongside the suspension tubing until a point a short distance above the packer. At that point, the power cable extends through a window provided in the suspension tubing. The power cable extends through the interior of the packer and into the connection box.

In the connection box, the feed through connections are made. Also, heat pipes extend through the packer from the connector box to a point above the packer. These heat pipes are sealed elements containing a gas such as ammonia which circulates due to convection. The circulation aids in the dissipation of heat from the interior of the connector box.

DESCRIPTION OF THE PREFERRED EMBODIMENT

Figure 1A:
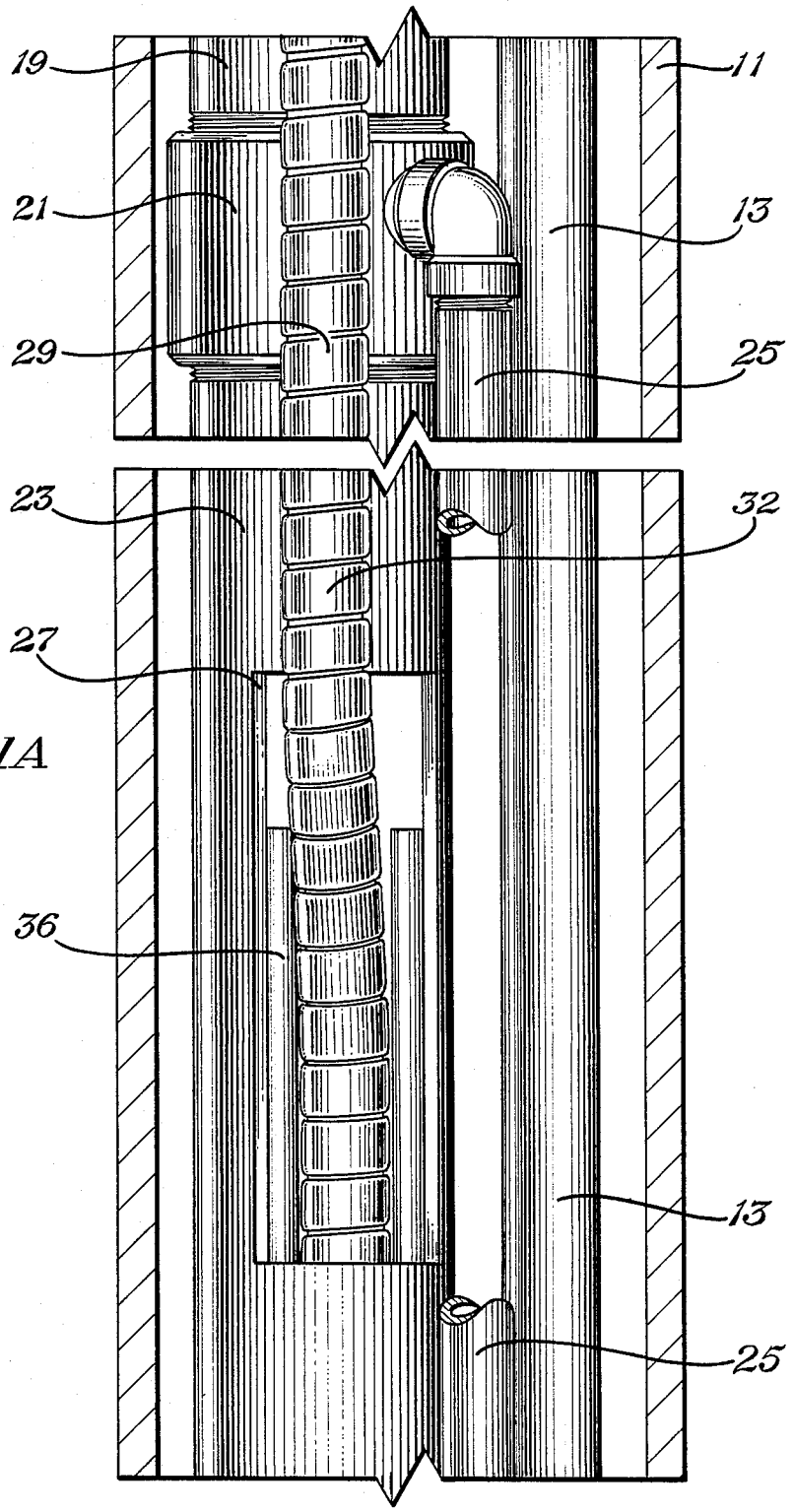
FIGS. 1A, 1B and 1C are a side view, partially in section, of a completion system for a downhole steam generator constructed in accordance with this invention.

Referring to FIG. 1A, the well contains casing 11. A water supply tube or line 13 will extend from the surface down through the casing 11 to a steam generator 15, shown in FIG. 1C. The water supply line 13 is offset from the axis of the casing 11. The steam generator 15 is not shown in detail. It will have electrodes for heating the water supplied through the water supply line 13 sufficiently to cause steam to flow into the earth formation.

Figure 1B:
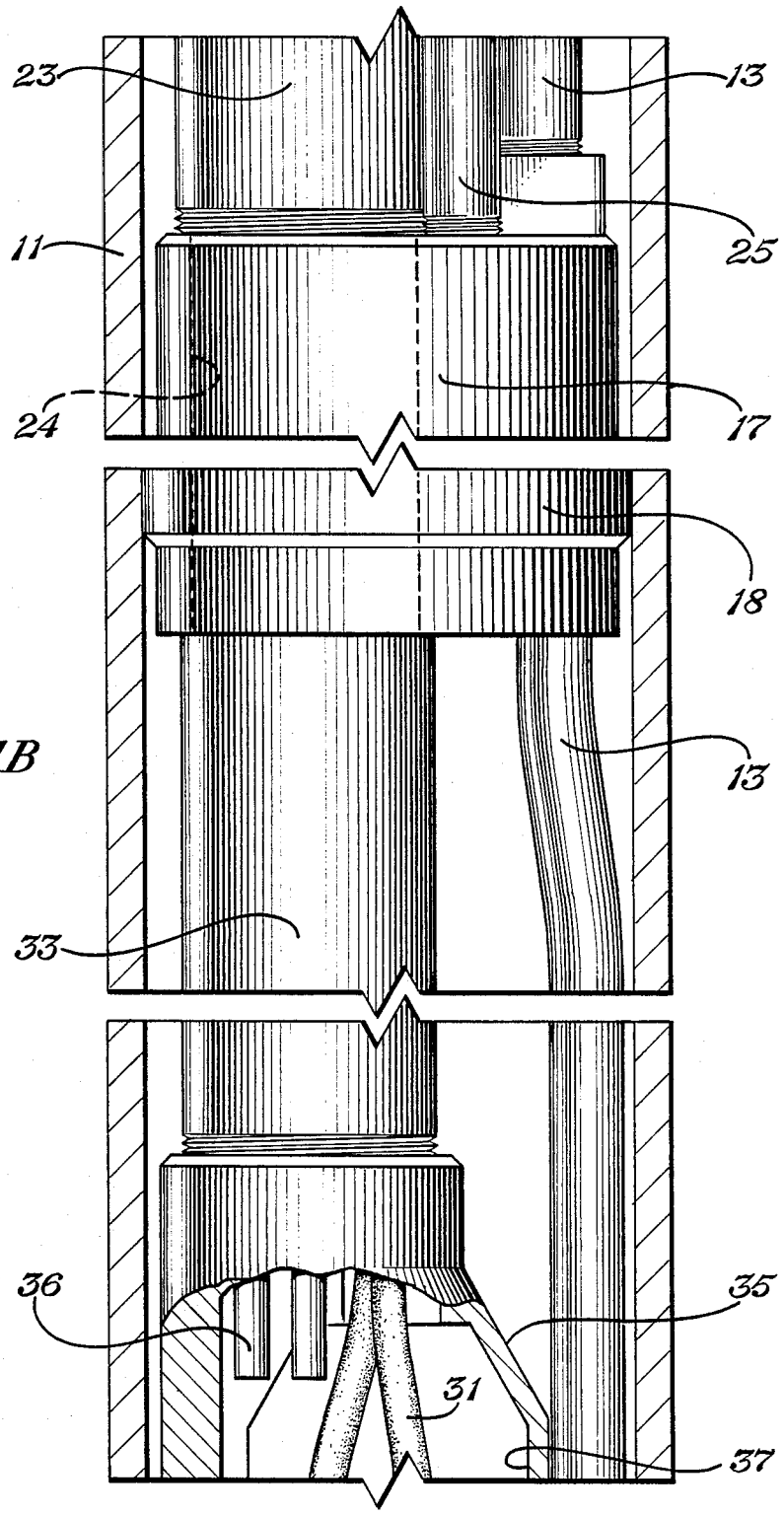

As shown in FIG. 1B, a packer 17 is located above the steam generator 15. The packer 17 will be a conventional high temperature packer having an elastomeric sealing element 18 which is expanded into sealing engagement with the casing 11. Packer 17 is preferably of a type that is set by hydraulic pressure, and once set, the sealing element 18 will remain in place even though the hydraulic pressure is relieved.

The packer 17 is lowered into place on a string of suspension tubing 19, shown also in FIG. 1A. Tubing 19 is usually at least twice the diameter of the water supply line 13. The tubing 19 extends to the surface and is made up of sections approximately 30 feet in length screwed together.

As shown in FIG. 1A, a coupling 21 connects the tubing 19 to a tubing joint 23, which is also part of the string of tubing 19. Joint 23 is secured to the top of the packer 17 (FIG. 1B) in axial alignment with a passage 24 extending through the packer 17. A setting tube 25 extends from the coupling 21 to the packer 17 (FIG. 1B). A plate (not shown) in the coupling 21 directs water pumped down the tubing 19 into the setting tube 25. The water enters the packer 17 and acts against a conventional setting mechanism (not shown) in the packer 17 to expand the sealing element 18.

As shown in FIG. 1A, a window 27 is formed in the joint 23 directly above the packer 17. A power cable 29 extends from the surface alongside the tubing 19. Power cable 29 enters window 27 and passes straight through the passage 24 in the packer 17, through a conduit 33, and into a connection box 35, shown in FIG. 1B. Power cable 29 has three insulated electrical wires 31 (FIG. 1B). Power cable 29 is wrapped in a metallic outer armor 32. The armor 32 terminates below the passage 24, and the lower ends of the wires 31 protrude a short distance below the armor 32.

Referring to FIG. 1B, conduit 33 is insulated and coaxial with the passage 24. The connector box 35 is mounted to the lower end of the conduit 33. Connector box 35 is a sealed insulated housing in communication with the interior of the conduit 33, the passage 24 and the tubing joint 23. Connector box 35 is cylindrical and has a diameter that is as large as possible, preferably at least three-fourths the inner diameter of the casing 11. The axis of the connector box 35 is offset from the axis of casing 11. The water supply line 13 extends alongside the connector box 35.

A plurality of heat pipes 36 extend from the connector box 35 upward through the conduit 33, packer passage 24 and into the tubing joint 23, as shown in FIG. 1A. The top of each heat pipe 36 is adjacent the window 27. Each heat pipe 36 is sealed and contains a gas such as ammonia. The greater heat in the connector box 35 than above packer 17 will cause the gas in the heat pipes 36 to rise. The temperature at the top of each heat pipe 36 adjacent the window 27 (FIG. 1A) is cooler than in the connector box 35. This causes the gas to cool at the top and circulate back due to convection. The circulation within each heat pipe 36 assists in removing heat from the connector box 35 and dissipating the heat to a point above the packer 17.

Figure 1C:
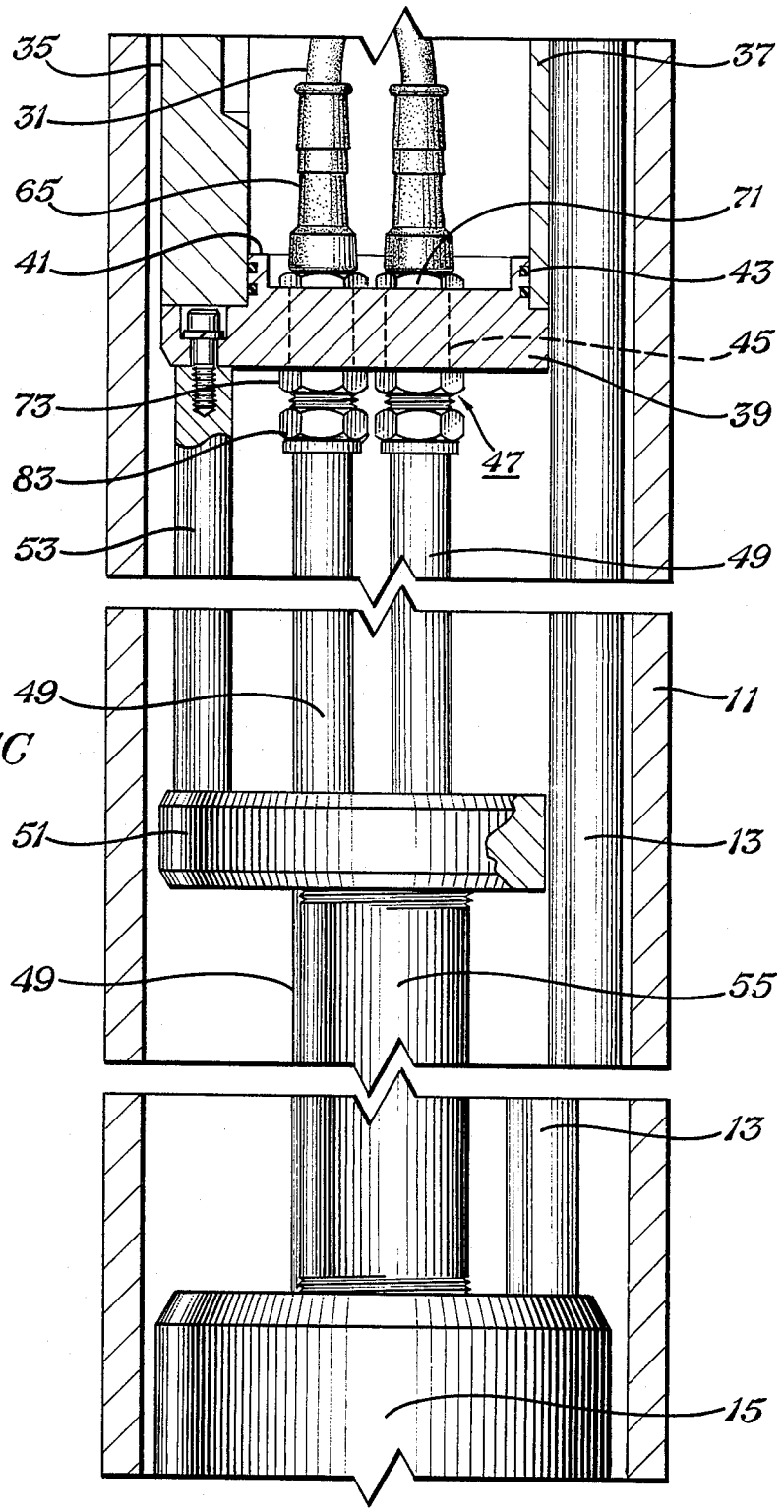

Referring to FIG. 1C, the connector box 35 has a cylindrical sidewall 37 and a bottom connector plate 39. The plate 39 has a neck 41 that is closely received in the sidewall 37. Seals 43 seal the interior of the connector box 35 from the exterior. The connector box 35 is preferably filled with a dielectric electrical insulating fluid.

Three passages 45 extend through the plate 39. A feed through connector 47 is located in each passage 45. The power cable wires 31 are connected to the feed through connectors 47. Also, wires 49 leading upward from the steam generator 15 are connected to the lower ends of the feed through connectors 47.

An adapter plate 51 is located between the connector box 35 and the steam generator 15. The adapter plate 51 is connected to the connector box 35 by a plurality of rods 53 (only one shown). A support tube 55 extends between the adapter plate 51 and the steam generator 15.

Figure 2:
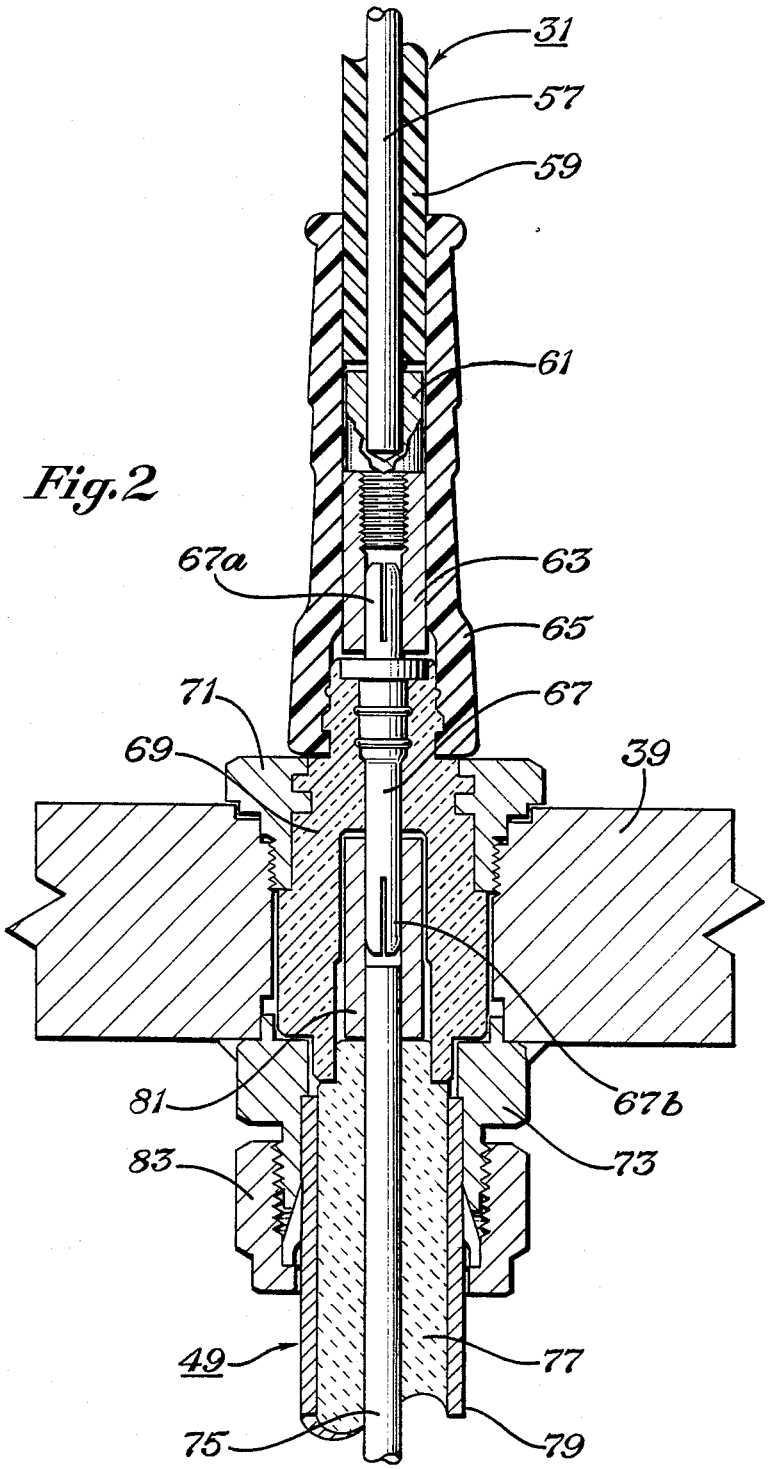
FIG. 2 is an enlarged vertical sectional view of one of the feed through connectors used with the completion system of FIG. 1.

Referring to FIG. 2, each insulated wire 31 from the power cable 29 (FIG. 1A) has an electrical conductor 57 located within an insulating jacket 59. A connector 61 having a male threaded end is joined to the lower end of the conductor 57. A female connector 63 has a threaded upper end that screws onto the male end of the connector 61. The lower end of female connector 63 is tubular. The connectors 61, 63 provide an electrical terminal for each wire 31. An elastomeric boot 65 surrounds the connectors 61, 63.

A feed through rod 67 is located in the plate passage 45. The feed through rod 67 has male ends **67*a* and 67*b* on each end. The feed through rod 67 is molded in an insulator 69 that is located within the passage 45. A nut 71 secures the insulator 69 in the passage on the upper end. A fitting 73 is welded to the lower side of plate 39 concentric with each passage 45. Fitting 73 supports the lower end of the insulator 69**.

The wires 49 each include an electrical conductor 75 located within an insulating jacket 77 that is made up of mineral insulation. A steel sheath 79 surrounds the insulating jacket 77. A female terminal or connector 81 is located on the upper end of the steam generator wire 49. A nut 83 engages threads on the fitting 73 to secure the steam generator wire 49 in place on the lower end **67*b* of each feed through rod 67**.

In operation, the steam generator 15 is assembled with the connector box 35 and packer 17 at the surface. This assembly is lowered on the tubing 19 to the desired level. The power cable 29 and the water supply line 13 are lowered at the same time. Then, water is pumped down the tubing 19 and into the setting tube 25. The water flows into the setting mechanism (not shown) of the packer 17 (FIG. 1B) and causes the packer 17 to expand its sealing element 18 outward into sealing engagement with the casing 11.

Then, electrical power is supplied from the surface to the power cable 29. The three phase power passes through the feed through connectors 47 (FIG. 1C) to the steam generator 15. Water is pumped down the water supply line 13 to the steam generator 15. The steam generator 15 heats the water to cause steam which then flows into the formation. The pressure of the water and the heat from the steam cause the crude in the formation to flow up adjacent production wells.

The invention has significant advantages. The connector box provides a greater diameter than conventional feed through mandrels for packers. This allows the feed through connector rods to be spaced farther distances apart, thereby significantly improving the ability to insulate against the high voltage. By passing the power cable completely through the main passage in the packer a separate feed through mandrel in the packer is not required. Positioning a connector box below the packer also allows a conventional packer to be used using lower temperature components than would otherwise be required. The heat pipes aid in dissipating heat from the connector box.

While the invention has been shown in only one of its forms, it should be apparent to those skilled in the art, that it is not so limited but is susceptible to various changes without departing from the scope of the invention.

I claim:

1. An apparatus for providing electrical power to a downhole steam generator in a cased well, comprising in combination:

a packer supported on a string of tubing, the packer having means for sealing against casing in the well and at least one conduit extending longitudinally through the packer;

a connector box mounted below the lower end of the packer, the connector box having a connector plate containing a plurality of passages;

a plurality of feed through electrical connectors mounted in insulators in the passages in the connector plate;

support means for mounting the steam generator below the connector box;

an aperture located in the sidewall of the tubing immediately above the packer;

an electrical cable extending from the surface alongside the tubing into the aperture and through the conduit into the connector box, the electrical cable having a plurality of electrical conductors, each of which ends in a terminal that is electrically connected to one of the electrical connectors; and a plurality of electrical conductors extending between the steam generator and engaging a lower end of each electrical connector in the connection plate.

2. An apparatus for providing electrical power to a downhole steam generator in a cased well, comprising in combination:

a packer supported on a string of tubing, the packer having means for sealing against casing in the well and at least one conduit extending longitudinally through the packer;

a connector box mounted below the lower end of the packer, the connector box having a connector plate containing a plurality of passages;

a plurality of feed through electrical connectors mounted in insulators in the passage in the connector plate;

support means for mounting the steam generator below the connector box;

an aperture located in the sidewall of the tubing above the packer;

an electrical cable extending from the surface alongside the tubing into the aperture and through the conduit into the connector box, the electrical cable having a plurality of electrical conductors, each of which ends in a terminal that is electrically connected to one of the electrical connectors;

a plurality of electrical conductors extending between the steam generator and engaging a lower end of each electrical connector in the connection plate; and a plurality of sealed tubes extending from the connector box and through the conduit into the tubing, each tube containing a gas which is adapted to circulate due to convection from the heat created by the steam generator, to assist in dissipating heat from the connector box.

3. An apparatus for providing electrical power to a downhole steam generator in a cased well, comprising in combination:

a packer supported on a string of tubing, the packer having means for sealing against casing in the well and at least one conduit extending longitudinally through the packer and terminating a selected distance below the packer;

a connector box mounted to the lower end of the conduit, the connector box having a connector plate containing a plurality of passages;

a plurality of feed through electrical connectors mounted in insulators in the passages in the connector plate, each electrical connector including a conductor rod;

support means for mounting the steam generator to the lower end of the connector box;

an aperture located in the sidewall of the tubing above the packer;

an electrical cable extending from the surface alongside the tubing, into the aperture and through the conduit into the connector box, the electrical cable having a plurality of electrical conductors, each of which ends in a terminal that is electrically connected to one of the conductors rods of each electrical connector; and a plurality of electrical conductors extending from the steam generator and engaging a lower end of each conductor rod in the connection plate.

* * * * *